US008040038B2

(12) United States Patent
Brunetti et al.

(10) Patent No.: US 8,040,038 B2
(45) Date of Patent: Oct. 18, 2011

(54) HIGH FREQUENCY, COLD CATHODE, TRIODE-TYPE, FIELD-EMITTER VACUUM TUBE AND PROCESS FOR MANUFACTURING THE SAME

(75) Inventors: Francesca Brunetti, Frascati (IT); Aldo Di Carlo, Rome (IT); Massimiliano Lucci, Rome (IT); Silvia Orlanducci, Rome (IT); Riccardo Riccitelli, Lariano (IT); Maria Letizia Terranova, Rome (IT)

(73) Assignee: Selex Sistemi Integrati S.p.A. (IT)

( * ) Notice: Subject to any disclaimer, the term of this patent is extended or adjusted under 35 U.S.C. 154(b) by 0 days.

(21) Appl. No.: 12/521,641

(22) PCT Filed: Dec. 29, 2006

(86) PCT No.: PCT/IT2006/000883

§ 371 (c)(1),
(2), (4) Date: Jun. 29, 2009

(87) PCT Pub. No.: WO2008/081482

PCT Pub. Date: Jul. 10, 2008

(65) Prior Publication Data

US 2010/0072878 A1 Mar. 25, 2010

(51) Int. Cl.

| | |
|---|---|
| ***H01J 1/62*** | (2006.01) |
| ***H01J 63/04*** | (2006.01) |
| ***H01J 9/00*** | (2006.01) |

(52) U.S. Cl. ..... 313/495; 313/496; 313/497; 313/293; 313/306; 445/24; 445/23

(58) Field of Classification Search ..... None
See application file for complete search history.

(56) References Cited

U.S. PATENT DOCUMENTS

| | | | | |
|---|---|---|---|---|
| 6,137,213 | A * | 10/2000 | Moyer et al. | 313/309 |
| 2004/0169458 | A1 | 9/2004 | Fran et al. | |
| 2006/0066216 | A1 * | 3/2006 | Koga et al. | 313/496 |

FOREIGN PATENT DOCUMENTS

| | | |
|---|---|---|
| JP | 2006024516 | 1/2006 |
| JP | 2006128083 | 5/2006 |
| JP | 2006253100 | 9/2006 |
| WO | WO0024027 | 4/2000 |

OTHER PUBLICATIONS

"Chip-Level Vacuum Packaging of Micromachines Using NanoGetters," Sparks D R et al., IEE Transactions on Advanced Packaging, IEEE Service Center, Piscataway, NJ vol. 26, No. 3, Aug. 2003, pp. 277-282.

* cited by examiner

*Primary Examiner* — Natalie K Walford
(74) *Attorney, Agent, or Firm* — The Belles Group, P.C.

(57) ABSTRACT

Disclosed herein is a high frequency, cold cathode, triode-type, field-emitter vacuum tube including a cathode structure, an anode structure spaced from the cathode structure, and a control grid, wherein the cathode structure and the anode structure are formed separately and bonded together with the interposition of spacers, and the control grid is integrated in the anode structure.

14 Claims, 5 Drawing Sheets

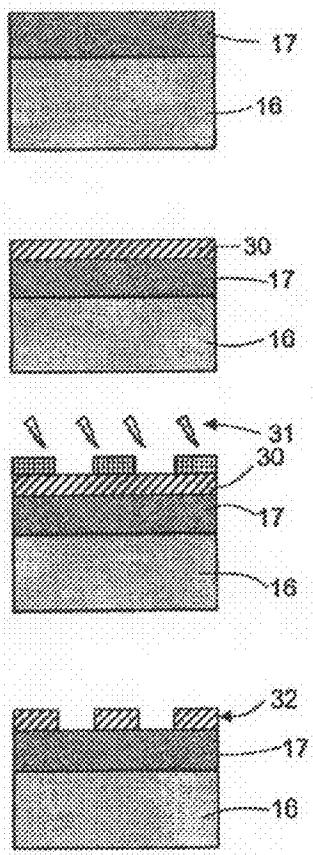
Fig.3a
Fig.3b
Fig.3c
Fig.3d
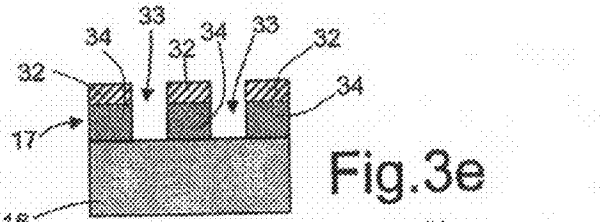
Fig.3e
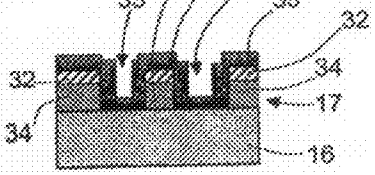
Fig.3i
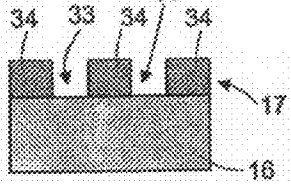
Fig.3f
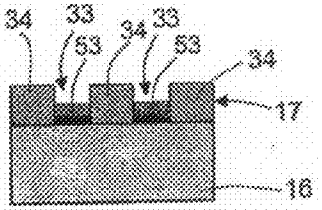
Fig.3l
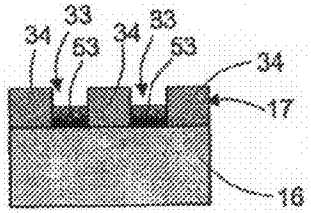
Fig.3g
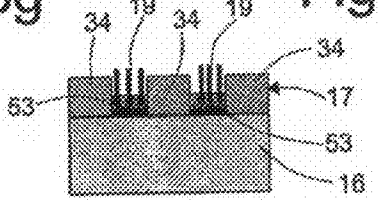
Fig.3h

HIGH FREQUENCY, COLD CATHODE, TRIODE-TYPE, FIELD-EMITTER VACUUM TUBE AND PROCESS FOR MANUFACTURING THE SAME

CROSS-REFERENCE TO RELATED PATENT APPLICATIONS

The present application is a U.S. national stage application under 35 U.S.C. §371 of PCT Application No. PCT/IT2006/000883, filed Dec. 29, 2006, the entirety of which is incorporated herein by reference.

TECHNICAL FIELD

The present invention relates in general to a micro/nanometrical device belonging to the family of semiconductor vacuum tubes for high frequency applications, and more particularly to a high frequency, cold cathode, triode-type, field-emitter vacuum tube and to a process for manufacturing the same.

BACKGROUND ART

As is known, in the last thirty years, and in particular after the publication by Charles Spindt of his first article on the manufacture of cold cathode vacuum tubes (C. A. Spindt et al., *Physical properties of thin-film field emission cathodes with molybdenum cones*, Journal of Applied Physics, vol. 47, December 1976, pages 5248-5263), there has been a renewed interest in the manufacture of high frequency, wide band, radiation insensitive vacuum tubes. This renewed interest is justified by the fact that this type of electronic devices, which, for generating an electron beam, exploit the field emission phenomenon instead of the thermionic phenomenon exploited by the conventional, old generation vacuum tubes, lend themselves to an ever increasing miniaturization.

In fact, the conventional vacuum tubes suffered from limitations due to the use of a thermionic cathode for electron emission, which cathode, in order to emit electrons, had to reach high operating temperatures of about 800 to 1200° C., with consequent problems linked to the management of the electrical power necessary to operate the vacuum tube (in a tube operating at low electrical power, namely less than 10 W, the electrical power necessary to heat up the cathode may be higher than the operating one) and of the so-called heating-up time (thermionic effect initiation time), and also linked to the stabilization of the control grid, which, in high frequency applications, was too close to the cathode (<25 μm) (see for example C. Bower, W. Zhu, D. Shalom, D. Lopez, G. P. Kochanski, P. L. Gammel, S. Jin, *A micromachined vacuum triode using a carbon nanotube cold cathode*, IEEE transactions on Electron Devices, Vol. 49, August 2002, pages 1478-1483).

On the contrary, the vacuum tube with a field emission array (FEA) cathode proposed by Spindt, generally known as Spindt Cathode, allowed the advantages provided by the vacuum electronics to be enjoyed, namely the property of the electrons of reaching higher speeds in the vacuum than in a semiconductor material. All these advantages are achieved with a substantially zero heating-up time, and with the possibility of arranging the control grid close to the cathode without having instability problems due to the heat of the electrodes, thus allowing higher operating frequencies to be reached (nominally from GHz to THz) and lower electrical power to initiate the electron generation process than necessary in thermionic tubes.

In particular, Spindt cathodes consist of microfabricated metal field emitter cones or tips formed on a conductive substrate. Each emitter has its own concentric aperture in an accelerating field generated by a gate electrode, also known as control grid, which is isolated from the substrate and the emitters by a silicon dioxide layer. With individual tips capable of producing several tens of microamperes, large arrays can theoretically produce large emission current densities.

Performance of Spindt cathodes are heavily limited by the destruction of the emitting tips due to their material wear, and for this reason many efforts have been spent worldwide in searching innovative materials for the production of the emitting tips.

In particular, the Spindt structure was improved by considering carbon nanotubes (CNTs) as cold cathode emitters (see for example S. Iijima, *Helical microtubules of graphitic carbon*, Nature, 1991, volume 354, pages 56-58, or W. Heer, A. Chatelain, D. Ugarte, *A carbon nanotube field-emission electron source*, Science, 1995, volume 270, number 5239, pages 1179-1180). Carbon nanotubes are perfectly graphitized, cylindrical tubes that can be produced with diameters ranging from about 2 to 100 nm, and lengths of several microns using different production processes. CNTs may be rated among the best emitters in nature (see for example J. M. Bonard, J.-P. Salvetat, T. Stöckli, L. Forrò, A. Châtelain, *Field emission from carbon nanotubes: perspectives for applications and clues to the emission mechanism*, Applied Physics A, 1999, volume 69, pages 245-254) and are ideal field emitters in a Spindt-type device, so many efforts have been spent worldwide in studying their field emission properties.

FIG. 1 shows a schematic view of a known Spindt-type cold cathode triode 1 including a cathode structure 2; an anode electrode 3 spaced from the cathode structure 2 by means of lateral spacers 4; and a control grid 5 integrated in the cathode structure 2. The cathode structure 2 with the integrated control grid 5 and the anode electrode 3 are formed separately and then bonded together with the interposition of the lateral spacers 4. The anode electrode 3 is made up of a first conductive substrate functioning as an anode, while the cathode structure 2 is a multilayer structure including a second conductive substrate 7; an insulating layer 8 arranged between the second conductive substrate 7 and the grid 5; a recess 9 formed to penetrate the grid 5 and the insulating layer 8 so as to expose a surface of the second conductive substrate 7; and Spindt-type emitting tips 10 formed in the recess 9 in ohmic contact with the second conductive substrate 7 and functioning as a cathode.

DISCLOSURE OF THE INVENTION

The Applicant has noticed that the topographic configuration of known Spindt-type vacuum tubes, in which the control grid is formed over the cathode, suffers from different problems, and in particular:

manufacture of emitting tips integrated with the control grid typically requires a complex technological process because it is necessary to place the emitting cathode within a multilayer structure (conductive substrate—insulating oxide—grid metal), and this process typically requires a high number of technological steps, the complexity of which is due to the difficulty of integrating different technologies. For emitting cathodes made up of carbon nanotubes it is for example necessary to study the technological steps relating to the manufacture of the substrate, and hence typically the materials used for the manufacture and the topography of the structures, so as to allow the subsequent growth of the carbon nanotubes by using the typical techniques used for this purpose (HF-CVD, PE-CVD, laser ablation);

in devices with emitting tips that come out from an opening in the insulating layer, for example when carbon nanotubes are used as emitting tips, proximity of the control grid to the cathode may cause a short circuit between the control grid and the emitting tips, with consequent malfunctioning of the device;

the metal grid absorbs a non-neglectable part of the electrons emitted by the cathode (~10%, see for example Y. M. Wong, W. P. Kang, J. L. Davidson, B. K. Choi, W. Hofmeister, J. H. Huang, *Field emission triode amplifier utilizing aligned carbon nanotubes*, Diamond and related materials 2005, volume 14, issue 11-12, pages 2069-2073), so making the device performance worse; and the operating frequency of this type of device is heavily limited by the parasitic capacitance between the grid and the cathode. In fact, assuming that the grid and the cathode may be modeled as two flat and parallel planes, the parasitic capacitance is $C=\epsilon_0\epsilon_r(A/d)$, where $\epsilon_o$ is the vacuum permittivity, $\epsilon_r$ is the relative permittivity of the insulating material between the cathode and the grid, A is the area of the grid, and d is the distance between the cathode and the grid. From the foregoing, it is evident that the operating frequency of this type of device is heavily dependent on the topographic characteristics of the device itself.

The main objective of present invention is therefore to provide an innovative topographical configuration of cold cathode vacuum tubes and an innovative manufacturing method which allow the aforementioned drawbacks to be at least overcome.

This objective is achieved by the present invention in that it relates to a high frequency, cold cathode, triode-type, field-emitter vacuum tube and to a process for manufacturing the same, as defined in the appended claims.

The present invention achieves the aforementioned objective by varying the typical topography of the vacuum tube, and in particularly by forming the control grid over the anode, instead of over the cathode as in the known Spindt-type vacuum tubes, and then assembling the anode and the control grid formed thereover with the cathode, which is always manufactured separately from the anode (and the grid), with the interposition of spacers. Conveniently, during the formation of the grid over the anode, an additional insulating layer is formed between the anode and the grid to reduce leakage currents.

BRIEF DESCRIPTION OF THE DRAWINGS

For a better understanding of the present invention, preferred embodiments, which are intended purely by way of example and are not to be construed as limiting, will now be described with reference to the attached drawings (all not to scale), wherein:

FIGS. 3*a*-3*l* are lateral sectional views of a semiconductor wafer during successive steps of the manufacture of a cathode structure of the Spindt-type cold cathode field-emitter triode of FIG. 2, in accordance with an embodiment of the present invention;

FIGS. 4*a*-4*m* are lateral sectional views of a semiconductor wafer during successive steps of the manufacture of an anode structure of the Spindt-type cold cathode field-emitter triode of FIG. 2, in accordance with an embodiment of the present invention;

BEST MODE FOR CARRYING OUT THE INVENTION

The following discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein and defined in the attached claims.

Figure 1:
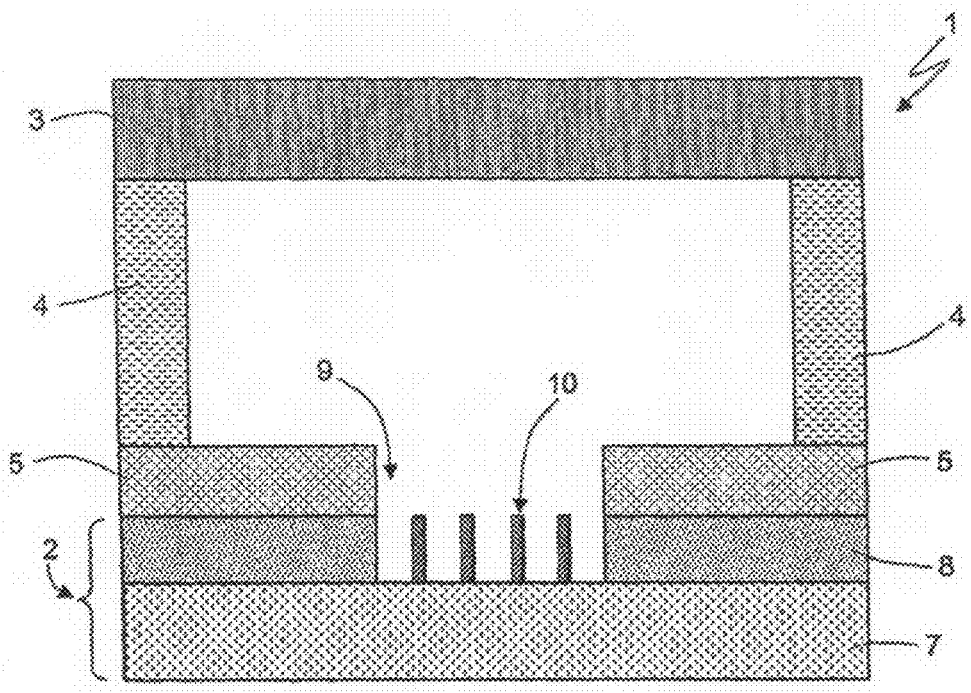
FIG. 1 shows a schematic view of a known Spindt-type cold cathode triode.
Figure 2:
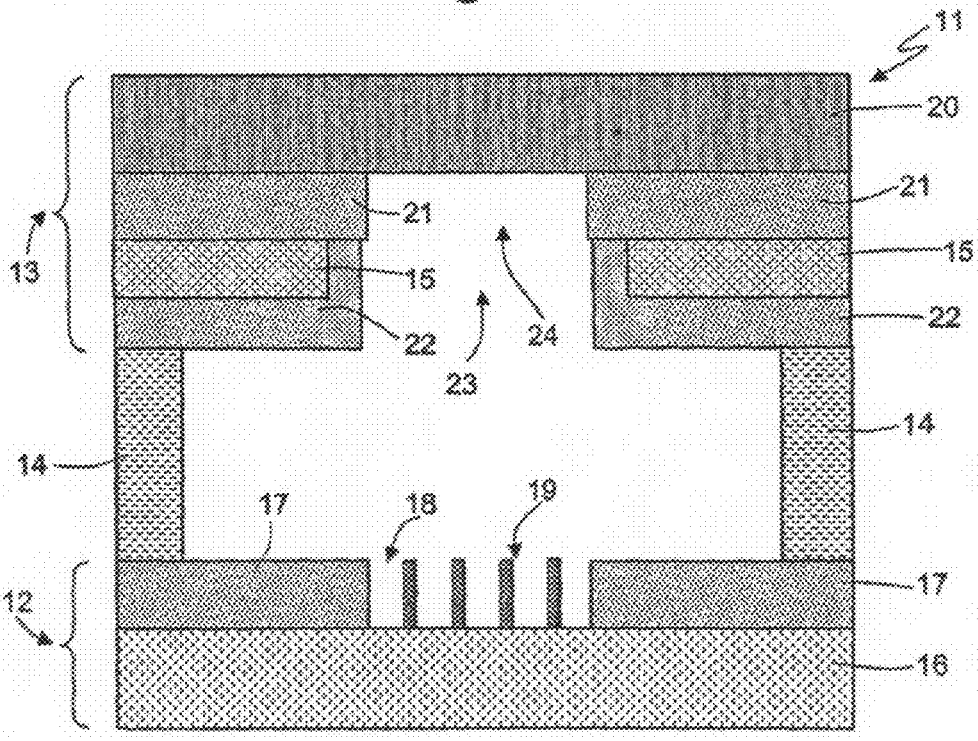
FIG. 2 shows a schematic view of a high frequency cold cathode triode-type field-emitter vacuum tube in accordance with an embodiment of the present invention.

FIG. 2 shows a schematic view of a high frequency cold cathode triode-type field-emitter vacuum tube in accordance with an embodiment of the present invention.

The cold cathode triode-type field-emitter vacuum tube, designated by 11, includes a cathode structure 12; an anode structure 13 spaced from the cathode structure 12 by means of lateral spacers 14; and a control grid 15 integrated in the anode structure 13. The cathode structure 12 and the anode structure 13 with the integrated grid 15 are formed separately and then bonded together with the interposition of the lateral spacers 14.

In particular, the cathode structure 12 is a multilayer structure including a first conductive substrate 16; a first insulating layer 17 formed on the first conductive substrate 16; a recess 18 formed to penetrate the first insulating layer 17 so as to expose a surface of the first conductive substrate 16; and emitting tips 19, in the form of carbon nanotubes, nanowires or Spindt-type tips, formed in the recess 18 in ohmic contact with the first conductive substrate 16, and functioning as a cathode.

The anode structure 13 is a multilayer structure including a second conductive substrate 20 functioning as an anode; a second insulating layer 21 formed between the second conductive substrate 20 and the grid 15; a double recess structure including a wide recess 23 formed to penetrate the grid 15 so as to expose a surface of the second insulating layer 21, and a narrow recess 24 formed in the wide recess 23 to penetrate the second insulating layer 21 so as to expose a surface of the second conductive substrate 20; and a third insulating layer 22 formed between the grid 15 and the lateral spacers 14 and covering also the side walls of the grid 15.

Recesses 18, 23 and 24 are vertically aligned in such a manner that the emitting tips 19 face the exposed surface of the second conductive substrate 20, and the lateral spacers 14 are arranged outside the recesses 18, 23 and 24 so that the recesses 18, 23 and 24 and the emitting tips 19 are arranged between the lateral spacers 14.

FIGS. 3*a*-3*l* are sectional views of a semiconductor wafer during successive steps of the manufacture of the cathode structure 12 of FIG. 2, in accordance with an embodiments of the present invention, where same reference numerals designate same elements. Additionally, for the sake of simplicity, the following description will refer to the manufacture of two adjacent cathode structures 12, the manufacture of an array of cathode structures 12 simply requiring the use of lithographical masks in which the same structure is repeated.

With reference to FIGS. 3*a*-3*l*, a 1-5 μm-thick insulating layer 17 made for example of silicon dioxide ($SiO_2$), is formed, in the example considered by oxidation, on a 300-μm thick conductive substrate 16 made for example of monocrystalline silicon (Si) (FIG. 3*a*). Then a masking layer 30, made for example of photoresist, is formed, for example by deposition, on the insulating layer 17 (FIG. 3*b*), then patterned, in the example considered by a masked UV exposure, designated by 31 (FIG. 3*c*), and subsequently developed, so forming a mask 32 with apertures which expose selective portions of the insulating layer 17 (FIG. 3*d*). The apertures are advantageously in the form of strips extending in a perpendicular direction to the sheet, are spaced from one another by approximately 5-20 μm, and have a width of 1-5 μm.

Using the mask 32, exposed portions of the insulating layer 17 are wet or dry etched, so forming trenches 33 in the insulating layer 17, which trenches 33 are laterally delimited by insulating columns 34, extend in depth as far as the conductive substrate 16, and have a shape, a width and a spacing corresponding to that of the apertures of the mask 32 (FIG. 3*e*). Additionally, each trench 33 defines a respective recess 18 in the insulating layer 17 (FIG. 2), where the emitting tips 19 will then be formed.

Then, in a first embodiment shown in FIGS. 3*f*, 3*g* and 3*h*, the mask 32 is removed (FIG. 3*f*) and vertically aligned carbon nanotubes emitting tips 19 (FIG. 3*h*) are synthesized in the trenches 33 by depositing a 20 nm-thick catalyst layer 35 (for example Fe or Ni) on the wafer by casting (the solution that may for example be used is $Fe(NO_3)_3.9H_2O$ in acetone) (FIG. 3*g*).

In a second, alternative embodiment shown in FIGS. 3*i* and 3*l*, the mask 32 is not removed and used as a mask for the 20 nm-thick catalyst layer 35, which is deposited on the wafer by sputtering (FIG. 3*i*), and then removed, by using a lift-off technique, from the insulating columns 34 and the lateral walls of the trenches 33 (FIG. 3*l*).

In a third, alternative embodiment (not shown), a further lithographic step may be provided to pattern the catalyst layer 35 in the trenches 33.

If the carbon nanotubes emitting tips 19 are grown as previously described with reference to FIGS. 3*f* and 3*g*, namely from a catalyst in solution deposited by casting, the selectivity is guaranteed by the reduction of the $Fe(NO_3)_3$ in the reaction chamber, which reduction takes place only in the areas of the conductive substrate 16 exposed via the lithographic process, while if the carbon nanotubes emitting tips 19 are grown as previously described with reference to FIGS. 3*i* and 3*l*, namely via a catalyst deposited by sputtering, the selectivity is guaranteed by the lithographic process which defines areas on which the catalyst is present, which catalyst, during the synthesis, has to be clustered.

FIGS. 4*a*-4*m* are sectional views of a semiconductor wafer during successive steps of the manufacture of the anode structure 13 of FIG. 2, in accordance with an embodiment of the present invention, where same reference numerals designate same elements. Additionally, for the sake of simplicity, the following description will refer to the manufacture of two adjacent anode structures 13, the manufacture of an array of anode structures 13 simply requiring the use of lithographical masks in which the same structure in repeated.

Figure 4A:
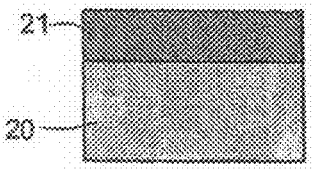
Figure 4B:
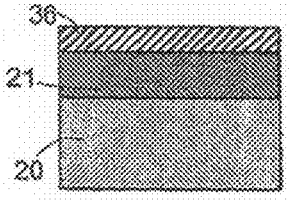
Figure 4C:
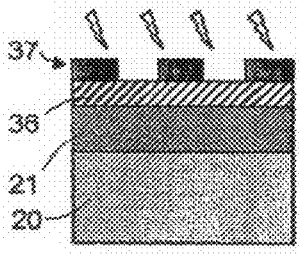
Figure 4D:
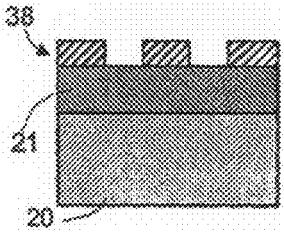

With reference to FIGS. 4*a*-4*m*, an insulating layer 21, made for example of silicon dioxide ($SiO_2$) and having a thickness from some microns to some tens of microns, is formed, in the example considered by oxidation, on a 300-μm thick conductive substrate 20 made for example of monocrystalline silicon (Si) (FIG. 4*a*). Then a first masking layer 36, for example made of photoresist, is formed, for example by deposition, on the insulating layer 21 (FIG. 4*b*), then patterned, in the example considered by a masked UV exposure, designated by 37 (FIG. 4*c*), and subsequently developed, so as to form a first mask 38 with apertures which expose selective portions of the insulating layer 21 (FIG. 4*d*). The apertures are advantageously in the form of strips extending in a perpendicular direction to the sheet, are spaced from one another by approximately 5-50 μm, and have a width of 1-5 μm.

Figure 4E:
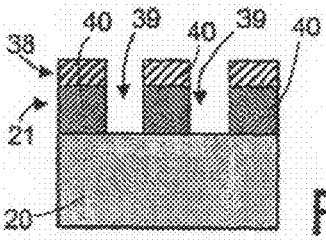
Figure 4F:
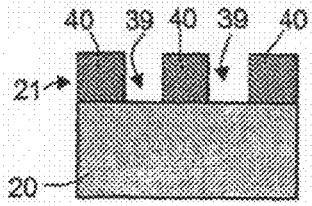

Using the first mask 38, exposed portions of the insulating layer 21 are dry or wet etched, so forming trenches 39 in the insulating layer 21, which trenches are laterally delimited by insulating columns 40, extend in depth as far as the conductive substrate 20, and have a shape, a width and a spacing corresponding to that of the apertures of the first mask 38 (FIG. 4*e*).

Figure 4G:
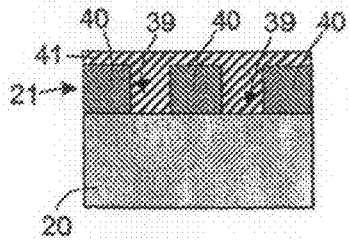
Figure 4H:
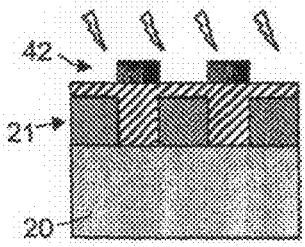
Figure 4I:
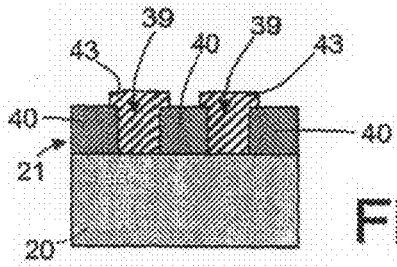
Figure 4L:
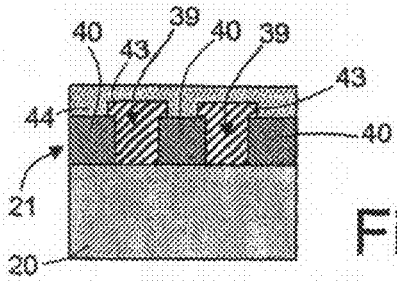
Figure 4M:
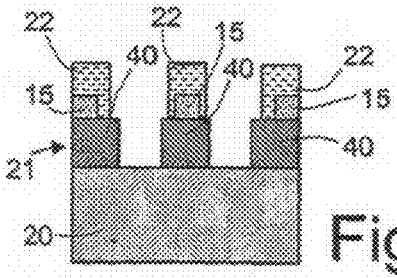

Then, the first mask 38 is removed (FIG. 4*f*) and a second masking layer 41, for example made of photoresist, is formed, in the example considered by deposition, which completely fills the trenches 39 and covers the insulating columns 40 (FIG. 4*g*). The second masking layer 41 is then patterned, in the example considered by a masked UV exposure, designated by 42 (FIG. 4*h*), so as to expose only the portions of the second masking layer 41 on the insulating columns 40, while leaving covered the portions of the second masking layer 41 on the trenches 39 (FIG. 4*h*), and subsequently developed, so as to form a third mask 43 which completely covers bottom and lateral walls of the trenches 39 and also partly extends on the insulating columns 40 for about 1-50 μm (FIG. 4*i*).

A 50-500 nm-thick metal grid layer 44 is then formed, for example by deposition, on the wafer, so as to completely fill the trenches 39 and cover the insulating columns 40 (FIG. 4*l*), and then removed, using a lift-off process, all over the entire surface of the wafer, except on the areas of the insulating columns 40 exposed by the third mask 43, thus forming the grid 15. Finally, a grid insulating layer 22, having the purpose of covering the grid 15 to prevent a shortcircuit of the grid with the emitting tips 19, is formed, in the example considered by oxidation, on the grid 15 by anodizing, thus obtaining the structure shown in FIG. 4*m*, where the internal vertical sides of the grid remain spaced out from the internal vertical sides of the insulating columns 40 of 1-20 μm, thus significantly limiting the leakage currents because the emitted electrons are not collected by the grid 15 which is covered by the oxide. As a general rule, as the dimension of the grid 15 depends on the grid-to-trench and grid-to-grid distances, the grid 15 has to be dimensioned consistently with the structure alignment process, which may vary depending on the applications which the cold cathode triode-type field-emitter vacuum tube 11 is designed for.

The cathode structure 12 and the anode structure 13 with integrated grid 15 formed as described above with references to FIGS. 3 and 4 are aligned and bonded together via the interposition of the lateral spacers 14, and creating the vacuum therebetween (vacuum bonding). The function of the lateral spacers 14 is that of allowing an electrical insulation between the cathode structure 12 and the anode structure 13 to be created and an effective vacuum bonding to be made. In particular, standard wafer-to-wafer vacuum bonding techniques may be used to join the cathode structure 12 and the anode structure 13, including anodic bonding, glass frit bonding, eutectic bonding, solder bonding, reactive bonding and fusion bonding.

One of the main problems of this type of packing techniques is linked to the pressure that is reached in the cavity between the cathode structure 12 and the anode structure 13. For example, in the anodic bonding the pressure in the cavity reaches values 100-400 Torr due to oxygen generation, while in the solder bonding the pressure in the cavity reaches values of 2 Torr due to gas desorption, which pressure may be reduced to 1 Torr if the wafers are heated up before assembly. Therefore, what happens is that while it is possible to obtain pressures below μTorr by using vacuum wafer bonding techniques, material desorption that happens as a result of the bonding (or assembly), the final pressure is always relatively high.

Since a high quality of vacuum is necessary for a good operation of the field-emitter vacuum tube 11, according to another aspect of the present invention, formation of a region containing a particularly reactive material such as Ba, Al, Ti, Zr, V, Fe, commonly known as getter, allows, when appropriately activated, molecules desorbed during the bonding to be captured. For a detailed description of getter material reference may be made to Douglas R. Sparks, S. Massoud-Ansari, and Nader Najafi, *Chip-Level Vacuum Packaging of Micromachines Using NanoGetters*, IEEE transactions on advanced packaging, volume 26, number 3, August 2003, pages 277-282, and Yufeng Jin, Zhenfeng Wang, Lei Zhao, Peck Cheng Lim, Jun Wei and Chee Khuen Wong, *Zr/V/Fe thick film for vacuum packaging of MEMS*, Journal of Micromechanics and Microengineering, volume 14, 2004, pages 687-692.

Figure 5A:
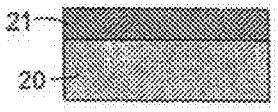
FIGS. 5*a*-5*q* are sectional views of a semiconductor wafer during successive steps of the manufacture of an anode structure, provided with a getter material, of a Spindt-type cold cathode field-emitter triode in accordance with an embodiment of the present invention.
Figure 5B:
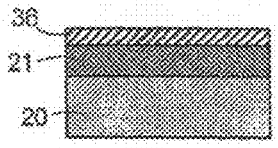
Figure 5C:
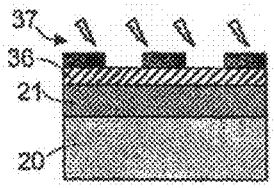
Figure 5D:
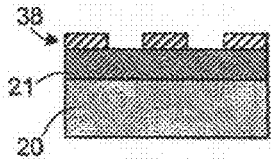
Figure 5E:
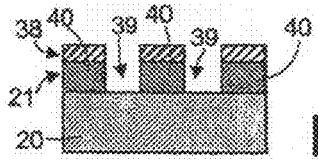
Figure 5F:
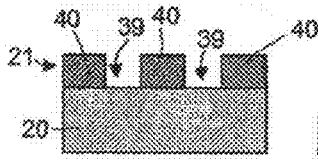
Figure 5G:
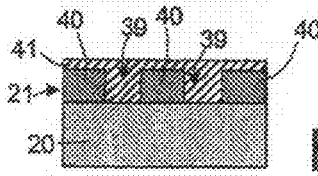
Figure 5H:
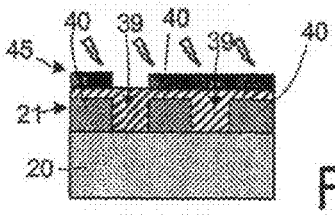
Figure 5I:
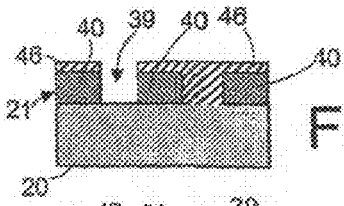
Figure 5L:
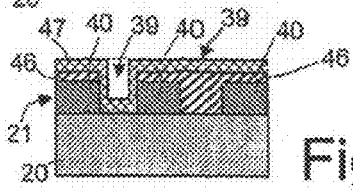
Figure 5M:
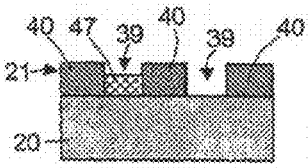
Figure 5N:
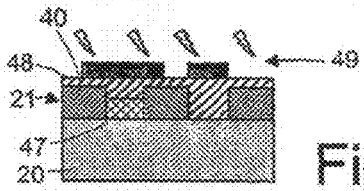
Figure 5O:
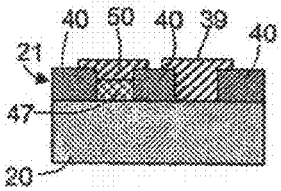
Figure 5P:
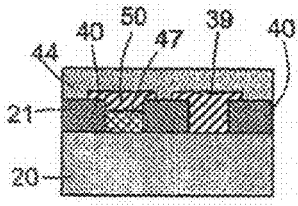
Figure 5Q:
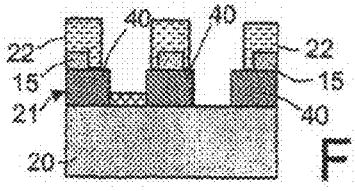

Introduction of the getter material in the field-emitter vacuum tube, hereinafter designated by 11', may be made by an additional step in the process of manufacture of the anode structure 13, as shown in FIGS. 5*a* to 5*q*, where FIGS. 5*a* to 5*g* are the same as FIGS. 4*a* to 4*g* and hence will not be described again.

With reference to FIGS. 5*a* to 5*q*, once the first mask 38 has been removed (FIG. 5*f*) and the second masking layer 41 has been formed (FIG. 5*g*), the second masking layer 41 is patterned, in the example considered by a masked UV exposure, designated by 45, so as to expose only a portion of the second masking layer 41 on one trench 39, while leaving covered the remaining portions of the second masking layer 41 on the insulating columns 40 and the other trench 39 (FIG. 5*h*), and subsequently developed, so as to form a third mask 46 which completely covers the insulating columns 40 and the bottom and lateral walls of the trench 39 that was not exposed during the masked UV exposure, while leaving exposed only the bottom and lateral walls of the trench 39 that was exposed during the masked UV exposure (FIG. 5*i*).

Then, a metal getter layer 47 having a thickness in the range of microns is formed, for example by deposition, on the wafer (FIG. 5*l*), and then removed, using a lift-off process, all over the entire surface of the wafer, except on the trench 39 that was not covered by the third mask 46 (FIG. 5*m*). A third masking layer 48, for example made of photoresist, is then formed, in the example considered by deposition, on the wafer so as to completely fill the trenches 39 and cover the insulating columns 40, and then patterned, in the example considered by a masked UV exposure, designated by 49, so as to expose only portions of the third masking layer 48 on the insulating columns 40, while leaving covered portions of the third masking layer 48 on the trenches 39, and in particular on the getter layer 47 (FIG. 5*n*). The third masking layer 48 is then developed so as to form a fourth mask 50 which completely covers the trench 39 that contains the getter 47 and also partly extends on the adjacent insulating columns 40 for about 1-50 μm, as well as completely covers the bottom and lateral walls of the other trench 39 that does not contain the getter 47 and also partly extends on the adjacent insulating columns 39 for about 1-50 mm (FIG. 5*o*).

Figure 6:
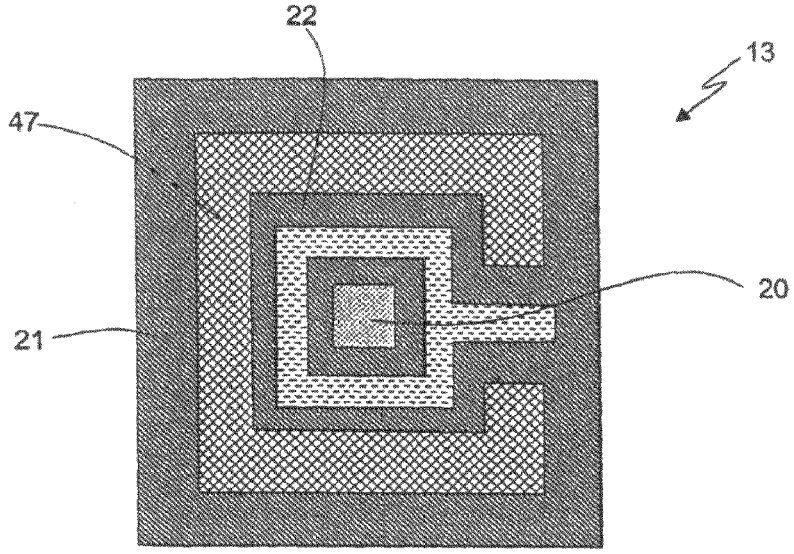
FIG. 6 is a top view of an anode structure, provided with a getter material, of a Spindt-type cold cathode field-emitter triode in accordance with an embodiment of the present invention.

A 50-500 nm-thick metal grid layer 44 is then formed, for example by deposition, on the wafer (FIG. 5*p*), and then removed, using a lift-off process, all over the entire surface of the wafer, except on the area of the insulating columns 39 exposed by the fourth mask 50, thus forming the grid 15. Finally, a grid insulating layer 22, having the purpose of covering the grid to prevent a shortcircuit of the grid with the emitting tips 19, is formed, in the example considered by oxidation, on the grid 15 by anodizing, thus obtaining the structure shown in FIG. 5*q*, where the internal vertical sides of the grid remain spaced out from the internal vertical sides of the insulating columns 39 of 1-50 μm, thus significantly limiting the leakage currents. Preferably, the grid 15 and the getter 47 have, in top view, a ring pattern of the type show in FIG. 6, where the grid 15 is not visible because completely covered by the grid insulating layer 22.

Figure 7:
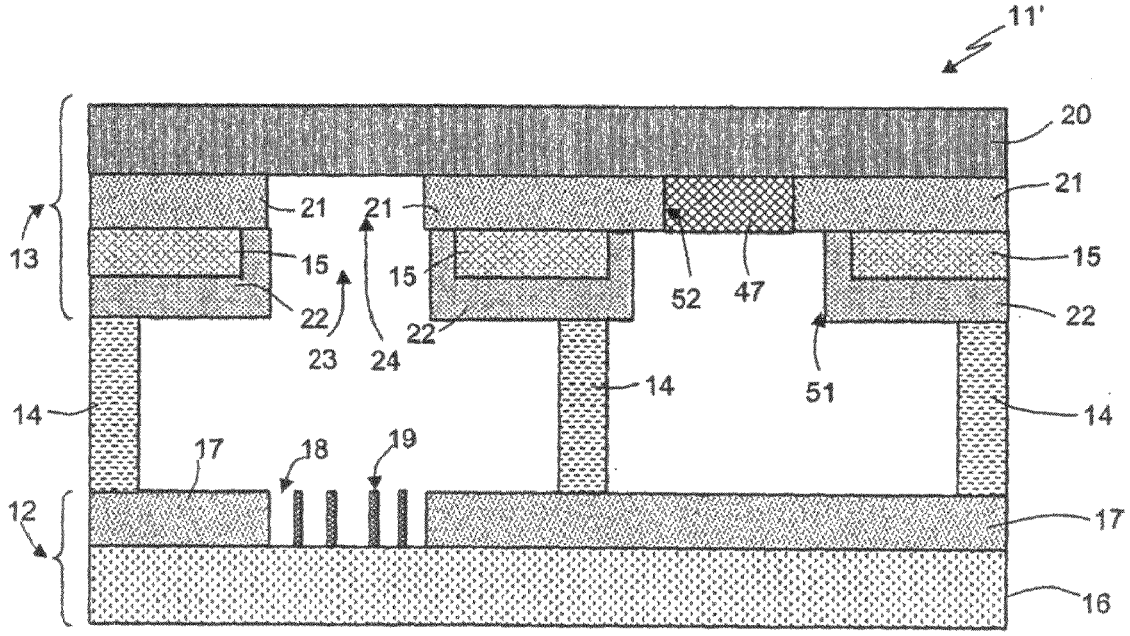
FIG. 7 shows a schematic view of a Spindt-type cold cathode triode-type field-emitter vacuum tube provided with a getter material, in accordance with an embodiment of the present invention.

Finally, the anode structure 13 with integrated grid 15 and getter 47 is bonded to the cathode structure 12, so forming the cold cathode triode-type field-emitter vacuum tube 11' shown in FIG. 7, wherein the left part is identical to that shown in FIG. 2, and the right part is structurally similar to the left part, namely it includes a double recess structure including a wide recess 51 formed to penetrate the grid 15 so as to expose a surface of the second insulating layer 21, and a narrow recess 52 formed in the wide recess 51 to penetrate the second insulating layer 21 so as to expose a surface of the second conductive substrate 20, wherein the wide and narrow recesses 51, 52 are separated from the wide and narrow recesses 23, 24 by a lateral spacer 14, and wherein the getter 47 is formed in the narrow recess 52.

The advantages of the field-emitter vacuum tube according to the present invention are evident from the foregoing. In particular:

- the integration of the grid 15 in the anode structure 13 instead of in the cathode structure 12 prevents any shortcircuit between the grid 15 and the emitting tips 19, and allows a simpler and highly reproducible manufacturing process to be obtained;
- the additional insulating layer 22 between the grid 15 and the lateral spacers 14 and the fact that the internal vertical sides of the grid 15 are spaced out from the internal vertical sides of the insulating layer 21 significantly reduce the leakage currents; and
- the thickness of the conductive substrate 20 and of the insulating layer 21 in the anode structure 13 allows a lower parasitic capacitance between the anode 20 and the grid 15 to be obtained and consequently a higher operating frequency to be reached.

Finally, numerous modifications and variants can be made to the field-emitter vacuum tube according to the present invention, all falling within the scope of the invention, as defined in the appended claims.

In particular, it may be appreciated by the skilled person that the thickness of the various layers of the field-emitter vacuum tube according to the present invention and the various steps of the respective manufacturing process are only indicative and may be varied according to specific necessity.

The invention claimed is:

1. A cold cathode triode-type field-emitter vacuum tube comprising:

a cathode structure;

an anode structure spaced from the cathode structure; and a control grid;

wherein the cathode structure and the anode structure are formed separately and bonded together with the interposition of spacers;

wherein the control grid is integrated in the anode structure; and wherein the anode structure includes a second conductive substrate, a second insulating layer formed between the second conductive substrate and the control grid, a third insulating layer formed between the control grid and the spacers, and a first recess structure formed to penetrate the third insulating layer, the control grid, and the second insulating layer so as to expose a surface of the second conductive substrate.

2. The field-emitter vacuum tube of claim 1, wherein the cathode structure includes a first conductive substrate, a first insulating layer formed on the first conductive substrate, a first recess formed to penetrate the first insulating layer so as to expose a surface of the first conductive substrate, and emitting tips formed in the first recess and in ohmic contact with the first conductive substrate.

3. The field-emitter vacuum tube of claim 1, wherein the first recess structure includes a first wide recess formed to penetrate the third insulating layer and the control grid so as to expose a surface of the second insulating layer, and a first narrow recess formed in the first wide recess to penetrate the second insulating layer so as to expose a surface of the second conductive substrate.

4. The field-emitter vacuum tube of claim 2, wherein the first recess structure and the first recess are vertically aligned in such a manner that the emitting tips face the exposed surface of the second conductive substrate, and the spacers are arranged outside the first recess structure and the first recess so that the first recess structure, the first recess and the emitting tips are arranged between the spacers.

5. The field-emitter vacuum tube of claim 1, further comprising a second recess structure formed to penetrate the third insulating layer, the control grid, and the second insulating layer so as to expose a surface of the second conductive substrate; and a getter material formed in the second recess structure.

6. The field-emitter vacuum tube of claim 5, wherein the second recess structure includes a second wide recess formed to penetrate the third insulating layer and the control grid so as to expose a surface of the second insulating layer, and a second narrow recess formed in the second wide recess to penetrate the second insulating layer so as to expose a surface of the second conductive substrate; and wherein the getter material is arranged in the second narrow recess.

7. The field-emitter vacuum tube of claim 5, wherein the first recess structure is separated from the second recess structure by a spacer.

8. A method for manufacturing a cold cathode triode-type field-emitter vacuum tube, comprising:

forming separately a cathode structure and an anode structure;

forming a control grid;

bonding together the cathode structure and the anode structure with the interposition of spacers;

wherein the control grid is formed integrated in the anode structure; and wherein the step of forming the anode structure includes:

forming a second conductive substrate;

forming a second insulating layer between the second conductive substrate and the control grid;

forming a third insulating layer between the control grid and the spacers; and forming a first recess structure to penetrate the third insulating layer, the control grid, and the second insulating layer so as to expose a surface of the second conductive substrate.

9. The method of claim 8, wherein the step of forming the cathode structure includes:

forming a first conductive substrate;

forming a first insulating layer on the first conductive substrate;

forming a first recess to penetrate the first insulating layer so as to expose a surface of the first conductive substrate; and forming emitting tips in the first recess and in ohmic contact with the first conductive substrate.

10. The method of claim 8, wherein the step of forming the first recess structure comprises:

forming a first wide recess to penetrate the third insulating layer and the control grid so as to expose a surface of the second insulating layer; and forming a first narrow recess in the first wide recess to penetrate the second insulating layer so as to expose a surface of the second conductive substrate.

11. The method of claim 9, wherein the first recess structure and the first recess are vertically, aligned in such a manner that the emitting tips face the exposed surface of the second conductive substrate, and the spacers are arranged outside the first recess structure and the first recess so that the first recess structure, the first recess and the emitting tips are arranged between the spacers.

12. The method of claim 8, further comprising:

forming a second recess structure to penetrate the third insulating layer, the control grid, and the second insulating layer so as to expose a surface of the second conductive substrate; and forming a getter material in the second recess structure.

13. The method of claim 12, wherein the step of forming the second recess structure comprises:

forming a second wide recess to penetrate the third insulating layer and the control grid so as to expose a surface of the second insulating layer; and forming a second narrow recess in the second wide recess to penetrate the second insulating layer so as to expose a surface of the second conductive substrate; and wherein the getter material is formed in the second narrow recess.

14. The method of claim 13, wherein the first recess structure is separated from the second recess structure by a spacer.

* * * * *